United States Patent [19]

Lee

[11] Patent Number: 4,651,994

[45] Date of Patent: Mar. 24, 1987

[54] GOLF CLUB SWING TRAINING DEVICE

[76] Inventor: Emmett W. Lee, 26097 S. Corral Hollow, Tracy, Calif. 95376

[21] Appl. No.: 801,426

[22] Filed: Nov. 25, 1985

[51] Int. Cl.[4] ..... A63B 69/36

[52] U.S. Cl. ..... 273/183 B; 273/188 R

[58] Field of Search ..... 273/183 B, 188 R, 188 A, 273/190 R, 190 A, 190 B, 190 C, 189 R, 189 A

[56] References Cited

FOREIGN PATENT DOCUMENTS 2117651 10/1983 United Kingdom ..... 273/183 B

*Primary Examiner*—George J. Marlo

*Attorney, Agent, or Firm*—Linval B. Castle

[57] ABSTRACT

A training device for correcting the leg stance of a golfer includes a floor plate upon which the golfer stands and which supports a rear post having at its top an arcuate partial clamp for preventing outward leg movement and body sway, and a vertical channel member adjustable along the floor plate and pivotally supporting a second post within the channel and moveable only in the direction of a drive for limiting rearward movement of the forward leg but not affecting forward movement of the rear leg during followthrough.

6 Claims, 8 Drawing Figures

GOLF CLUB SWING TRAINING DEVICE

BRIEF SUMMARY OF THE INVENTION

This invention relates generally to a golfer's training device and particularly to an adjustable stance stabilizing device for controlling and limiting a golfer's leg movement during the club swing.

During a golf swing, many golfers tend to sway so that both legs of a right handed golfer will move toward the right during the backswing. This results in a loss of timing of the weight shift to the left side during the downswing and loss of the required control over the drive.

The primary object of this invention is to provide a means for training a golfer to maintain a firm leg stance, without sway, during the golf club backswing thereby properly positioning the legs for the downswing and the weightshift.

Another object of the invention is to train a golfer to bend the knees at a proper angle while preparing for and during a backswing.

These and other objects and advantages of the invention will become apparent from the drawings and the description of the stance stabilizer.

Briefly described, the stance stabilizer includes a flat rectangular floor plate having attached thereto at one end a nearly vertical, angled post having at its top end a rigid curved retaining strap adapted to engage the right side of a right handed golfer's right leg below the knee to therby prevent leg sway toward the golfer's right. Longitudinally adjustable along the floor plate is a second post similarly angled post which, for a right handed golfer, may pivot toward the left but which cannot pivot toward the right. While addressing the ball, this second post is substantially centered between the right and left feet. However, during the golfer's backswing, the top end of this second post contacts the inside of the golfer's left leg to prevent the excessive left leg bending toward the right. Because the second post may pivot toward the left, it will contact but not interfere with the right leg during follow through of the swing.

DESCRIPTION OF THE DRAWINGS

In the drawings which illustrate the preferred embodiment of the invention.

DETAILED DESCRIPTION OF THE PREFERRED EMBODIMENT

Figure 1:
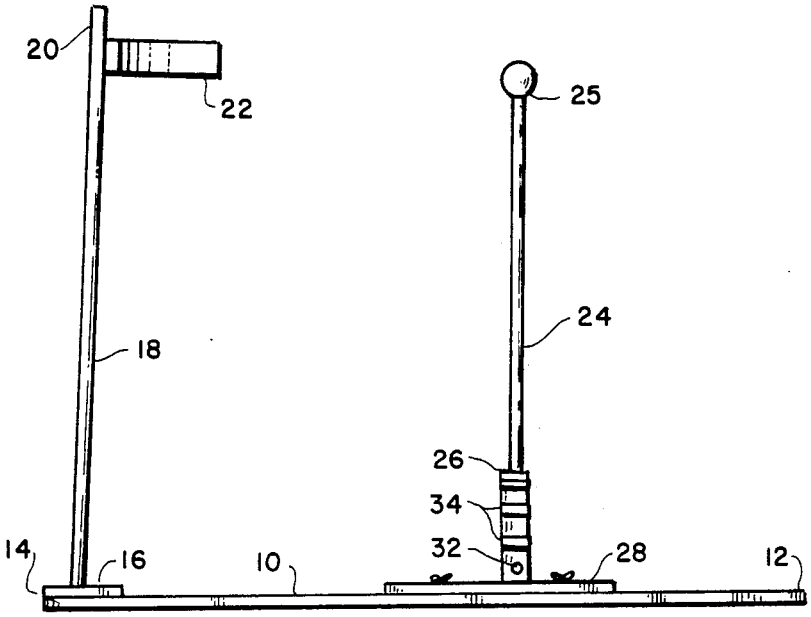
FIG. 1 is side elevational view illustrating the golf stance stabilizer.
Figure 2:
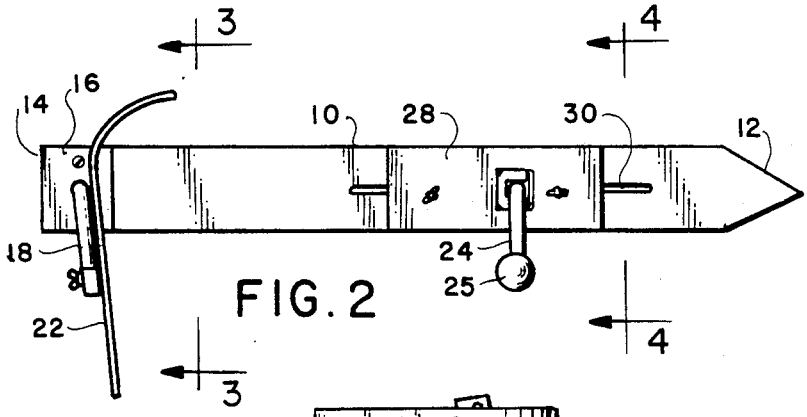
FIG. 2 is a plan view thereof.
Figure 3:
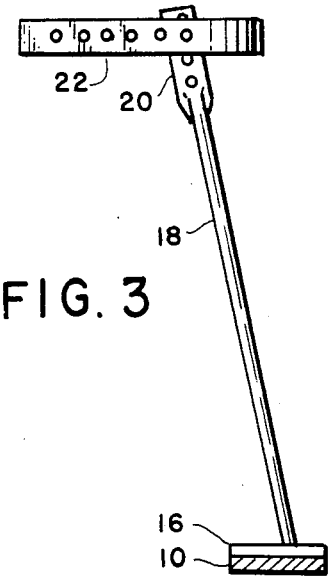
FIG. 3 is an elevational view taken along the lines 3—3 of FIG. 2.

FIG. 1 is a side elevational view of the stance stabilizer which includes a flat floor plate 10 that is approximately three inches in width and thirty inches in overall length. A first end 12 of the plate 10 may be pointed to indicate the direction of a golf drive. Firmly screwed to the top surface at the second end 14 is a rectangular plate 16 to which is welded a post 18. As illustrated in FIGS. 1, 2 and 3, the post 18 is mounted at a forward angle of approximately 84° with respect to the longitudinal horizontal centerline of the floor plate 10 to place the golfer's shoe on the floor plate adjacent the plate 16, and also at an angle approximately 78° to the lateral horizontal plane of the floor plate to assure that the golfer using the training device will bend the knees at a correct angle.

The post 18 has an overall length of approximately twenty inches and the top end 20 is flattened and provided with adjustment holes spaced about one inch to receive a rigid arcuate band 22 having a straight section with adjustment holes also spaced about one inch. Small bolts engaging the holes in the band 22 and in the end 20 then secure the arcuate band to the post 18 at an adjustment position that is proper for the particular golfer.

Figure 4:
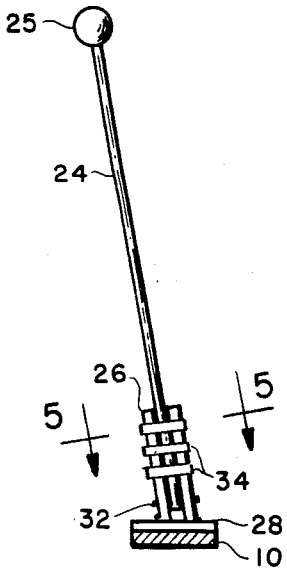
FIG. 4 is an elevational view taken along the lines 4—4 of FIG. 2.

Centered between the post 18 and the first end 12 of the floor plate is a second post 24 the top end of which may support a soft plastic sphere or ball 25 for preventing the tearing of a trouser leg and the lower end of which is pivotally mounted in a short channel member 26. The lower end of the channel member 26 is rigidly mounted to a rectangular stance adjustment plate 28 so that the member 26 is at right angles to the longitudinal plane of the plate 28 as shown in FIG. 1, and so that it is at an angle of approximately 78° to the lateral plane of the plate 28 as best shown in FIG. 4. The stance adjustment plate 28 overlies the top of the floor plate and is secured thereto by screws that engage a centerline slot 30 in the floor plate 10. The centerline slot 30 is sufficiently long to permit about a seven inch longitudinal adjustment of the stance adjustment plate 28 to provide for golfer's stance width variations.

Figure 5:
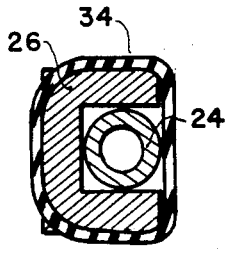
FIG. 5 is a sectional view taken along the lines 5—5 of FIG. 4.

The open side of the channel member 26 faces the pointed end 12 of the floor plate so that the second post 24, pivoted at 32, is restricted from movement in all directions except to pivot forward toward the direction of a golf drive. The post 24 is normally held in its vertical position by two or three elastic bands 34 that encircle the channel member 26 above the pivot 30 as best shown in FIG. 4. The bands 34 preferably engage a horizontal rounded slot in the channel member 26 to prevent breakage of the bands and to prevent vertical movement and slippage of the bands during their continued stretching as the post 24 is pivoted downward. The sectional plan view of FIG. 5 illustrates the rounded slots in the channel member 26.

Figure 6:
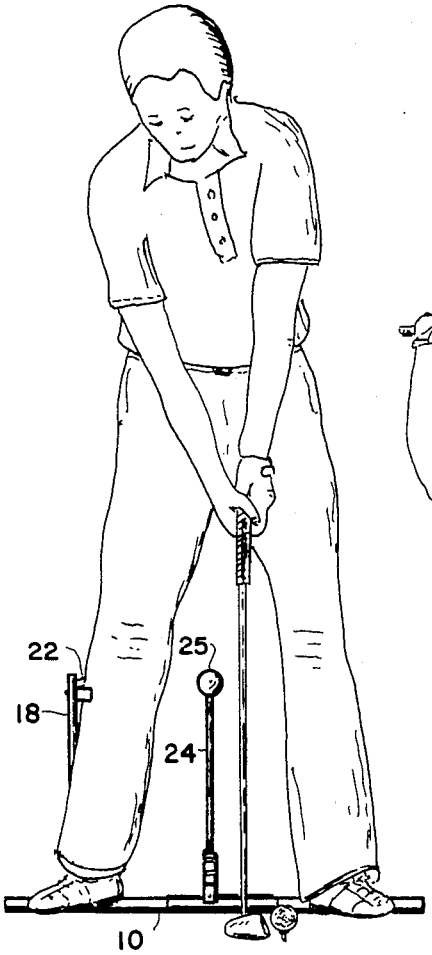
FIG. 6 is a pictorial view illustrating the stance stabilizer used by a golfer in addressing position.
Figure 7:
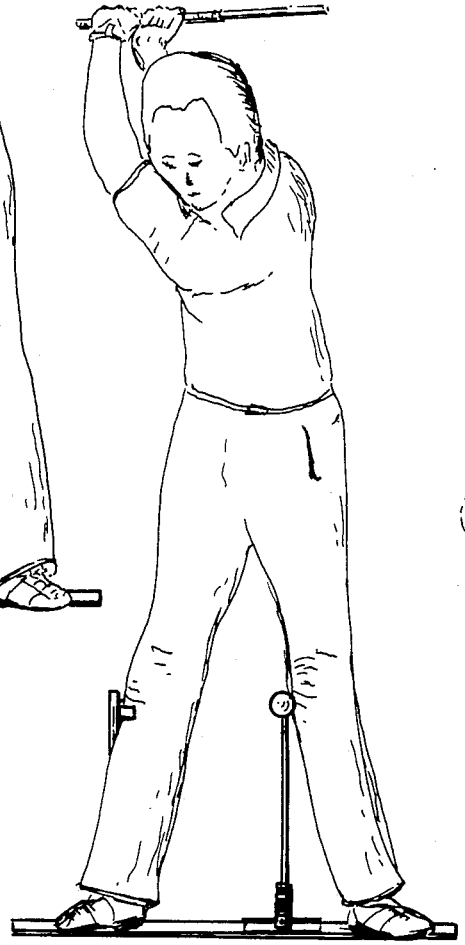
FIG. 7 is a pictorial view illustrating the golfer of FIG. 6 in backswing position.
Figure 8:
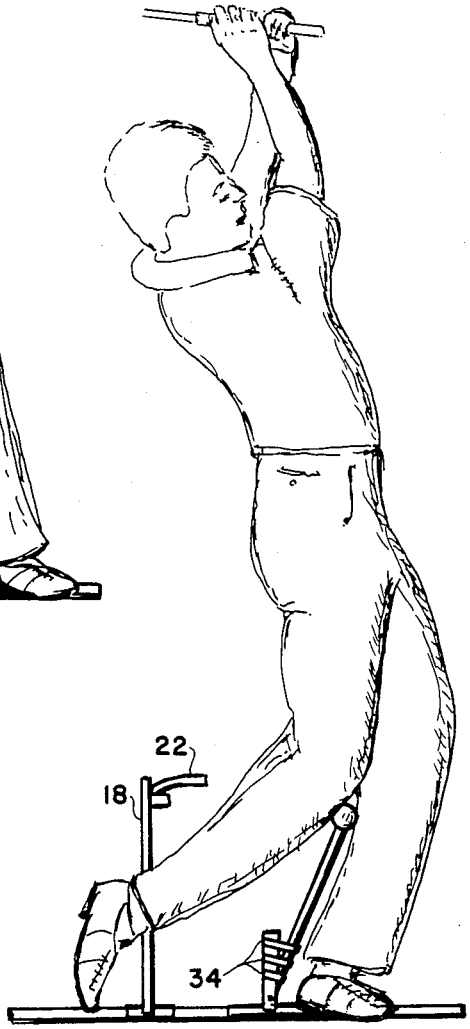
FIG. 8 is a pictorial view illustrating the golfer of FIGS. 6 and 7 in followthrough position.

FIGS. 6, 7 and 8 pictorially illustrate the operation of the golf stance stabilizer. In FIG. 6, a right handed golfer standing on the floor plate addresses a golf ball with his right leg slightly bent to confortably engage the properly adjusted arcuate band 22 at the top of the post 18. At this time, there is no contact with the sphere 25 on the second post 24 which has been adjusted to be about midway between the golfer's feet.

In FIG. 7, the golfer is in a backswing position. The right leg is still held by the rigid arcuate band 22 and cannot move further to the right. The left leg has been moved to the right to the point at which it has contacted the sphere 25 on the post 24 and is stopped at a proper position. Thus, sway toward the right of the right handed golfer has been eliminated; he is forced to pivot his body which will enable him to control his weight shift and have much greater control over the golf drive and the ball.

In FIG. 8, the golfer is shown in a follow through position. The right leg is no longer in contact with the arcuate band 22 and, during the downswing and weight shift to the left side, the right leg may contact the sphere 25 and pivot the post 24 toward the left without noticeable resistance from the elastic bands 34 that normally retain the post 24 in its vertical position.

The golf stance stabilizer has been described as being used only by a right handed golfer. For use by left handed golfers, it is only necessary to unbolt and replace the rear plate 16 that supports the fixed post 18 with a post laterally slanted in the opposite direction for controlling the knee bend and restricting left leg movement, and to replace the forward plate 28 with one in which the channel member 26 is similarly slanted in the opposite direction.

I claim:

1. A golfer's stance stabilizer for maintaining proper leg positions during club backswing and downswing, said stabilizer comprising:

an elongated floor plate having a top surface, a bottom surface, a first end facing the direction of travel of a golf ball, and a second end opposite said first end;

rigid means attached to and extending upward from the top surface of said floor plate and adjacent said second end, said rigid means for contacting the outer surface of the golfer's leg proximal said second end for limiting further movement of said leg toward said second end; and adjustable means adjustably coupled to and extending upward from the top surface of said floor plate and positionable between the feet of the golfer for contacting the inside of the golfer's leg distal of said second end during backswing and for limiting further movement of said distal leg toward said second end, and means for permitting said upward extending adjustable means to be moved in a single direction only toward the first end of said floor plate in response to contact with said golfer's leg distal of said second end so as not to resist follow-through.

2. The stabilizer claimed in claim 1 wherein said rigid means includes a post having one end connected to the top surface of said floor plate, said post supporting at the top end an adjustable leg engaging member for partially engaging the leg of a golfer, the position of said leg engaging member being laterally offset from a vertical line from the base of said post and in a direction away from the golfer for controlling the bending of the golfer's knees.

3. The stabilizer claimed in claim 2 wherein said leg engaging member is adjustable along the a portion of the length of said post for accomodating various lengths of golfer's legs.

4. The stabilizer claimed in claim 2 wherein said adjustable means includes includes a stance adjustment plate longitudinally adjustable along a portion of said floor plate, said adjustment plate having attached thereto a substantially vertical channel member with the open side thereof facing the first end of said floor plate, said channel member having pivoted therein a second post normally retained in a substantially vertical position.

5. The stabilizer claimed in claim 4 wherein said second post is retained in said channel member by at least one elastic band encircling said channel member, said second post being thereby pivotable forward toward the first end of said floor plate against the forces of said elastic band.

6. The stabilizer claimed in claim 5 wherein the upper end of said second post terminates in a substantially spherical member for contacting a golfer's leg.

* * * * *